United States Patent [19]

Yost, Jr.

[11] Patent Number: 4,508,229

[45] Date of Patent: Apr. 2, 1985

[54] SKI RACK

[76] Inventor: William G. Yost, Jr., 10440 Six Mile Rd., N.E., Rockford, Mich.

[21] Appl. No.: 493,987

[22] Filed: May 12, 1983

[51] Int. Cl.[3] ..... A47F 7/00

[52] U.S. Cl. ..... 211/70.5; D6/552; 211/4; 211/64

[58] Field of Search ..... 211/60 SK, 4, 60 G, 211/64, 68, 60 T, 7, 8; 248/222.1, 309.1; 280/814, 815; D6/125

[56] References Cited

U.S. PATENT DOCUMENTS

| | | | |
|---|---|---|---|
| 1,914,276 | 6/1933 | Moore . | |
| 2,070,507 | 2/1937 | Bishop | 211/13 |
| 2,710,100 | 6/1955 | Vermillion | 211/4 |
| 3,084,802 | 4/1963 | Ittner | 211/4 |
| 3,164,256 | 1/1965 | Bennett | 211/60 |
| 3,242,704 | 3/1966 | Barreca | 70/58 |
| 3,315,815 | 4/1967 | Wittek | 211/60 G |
| 3,330,573 | 7/1967 | Sieloff | 280/815 |
| 3,854,641 | 12/1974 | Kohls | 224/29 R |
| 3,865,667 | 8/1972 | Bell | 211/60 SK |
| 3,920,887 | 11/1975 | Kloos et al. | 248/68.1 X |
| 4,049,126 | 9/1977 | Halverson | D6/125 X |
| 4,222,490 | 9/1980 | Wood, Jr. | 280/814 X |

*Primary Examiner*—Ramon S. Britts
*Assistant Examiner*—Blair M. Johnson
*Attorney, Agent, or Firm*—Price, Heneveld, Huizenga & Cooper

[57] ABSTRACT

The specification discloses a ski-storage rack enabling skis to be easily, yet positively, stored in a vertical position against a wall. The rack includes a wall-mounted pegboard from which extends a plurality of linearly aligned, headed pegs horizontally spaced to receive skis therebetweeen. Further included is a keeper board mountable on the pegs to retain the skis in position between the keeper board and pegboard. The keeper board defines a plurality of downwardly opening slots cooperating with the headed pegs to permit the keeper board to be slid over the pegs but not pulled axially beyond the peg heads. Preferably, a floor box is also included to support the lower ends of the skis.

15 Claims, 3 Drawing Figures

SKI RACK

BACKGROUND OF THE INVENTION

The present invention relates to ski racks, and more particularly to ski racks including means for releasably securing the skis within the racks.

A wide variety of ski racks have been developed to store skis when not in use. Some known racks are specially adapted for supporting skis for transportation on an automotive vehicle as illustrated in U.S. Pat. No. 3,854,641, entitled ARTICLE CARRIER FOR RECREATIONAL VEHICLES, issued Dec. 17, 1974, to Kohls; and U.S. Pat. No. 3,242,704, entitled SKI RACKS, issued Mar. 29, 1966, to Barreca. Typcially, these vehicle racks are not suitable for use in a building interior because of the difficulty of mounting these racks on a vertical support surface such as a building wall. Second, the structure required to adequately support the skis during transportation is excessively strong and consequently expensive for a rack intended for interior use.

Other ski racks have been developed for stationarily supporting skis as illustrated in U.S. Pat. No. 3,685,667, entitled HOLDER APPARATUS FOR SKIS, issued Aug. 22, 1972, to Bell; and U.S. Pat. No. 3,164,256, entitled WATER SKI DISPLAY RACK, issued Jan 5, 1965, to Bennett. Typically, these stationary racks include a lower horizontal support member, upon which the lower ends of the skis are supported, and an upper horizontal support bar, vertically offset from the lower horizontal support bar and against which skis lean when supported on the rack. These stationary ski racks require excessive floor space, particularly when in a building interior, and consequently are unsuited for interior use, especially homes, where space is at a premium. Second, these racks either (1) include relatively complicated and costly securing mechanisms as in U.S. Pat. No. 3,685,667 or (2) do not include any securing mechanism as in U.S. Pat. No. 3,164,256 in which case the skis are often inadvertently knocked off the racks. Therefore, known stationary racks are excessively large, complicated, and/or costly.

SUMMARY OF THE INVENTION

The aforementioned problems are solved by the present invention comprising a ski rack for easily, positively, and compactly storing skis against a generally vertical support surface such as an interior building wall. More particularly, the ski rack comprises a peg board to be secured to a vertical support surface and includes a base supporting a plurality of generally linearly aligned pegs extending in a common direction therefrom. The pegs are horizontally spaced so that skis can be positioned therebetween. Each of the pegs includes a shaft portion and an enlarged head extending from the shaft portion generally opposite the peg board base. The rack further comprises a keeper board removably supported on the pegs and more particularly on the peg shafts. The keeper board defines a plurality of downwardly opening slots positioned to receive the peg shafts when the keeper board is supported thereon. The width of each slot is sufficiently wide to receive the peg shaft and sufficiently narrow to prevent the keeper board from passing axially beyond the peg heads after the keeper board has been installed on the pegs.

Skis are eaily and conveniently mounted in the ski rack of the present invention. Each ski is positioned substantially adjacent the vertical support surface and skis are inserted between a pair of horizontally adjacent pegs. After the skis have been so positioned, the keeper board is installed on the peg shafts securing the skis between the keeper board and the peg board base. Consequently, the skis are positively retained against the wall and cannot easily be inadvertently dislodged therefrom until the keeper board is removed permitting the skis to be withdrawn from the peg board.

In a preferred embodiment of the invention, the ski rack further includes an upwardly opening lower support box which rests on the floor. The lower ends of the skis are surrounded to assist in maintaining the upright position and close proximity of the skis to the wall.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
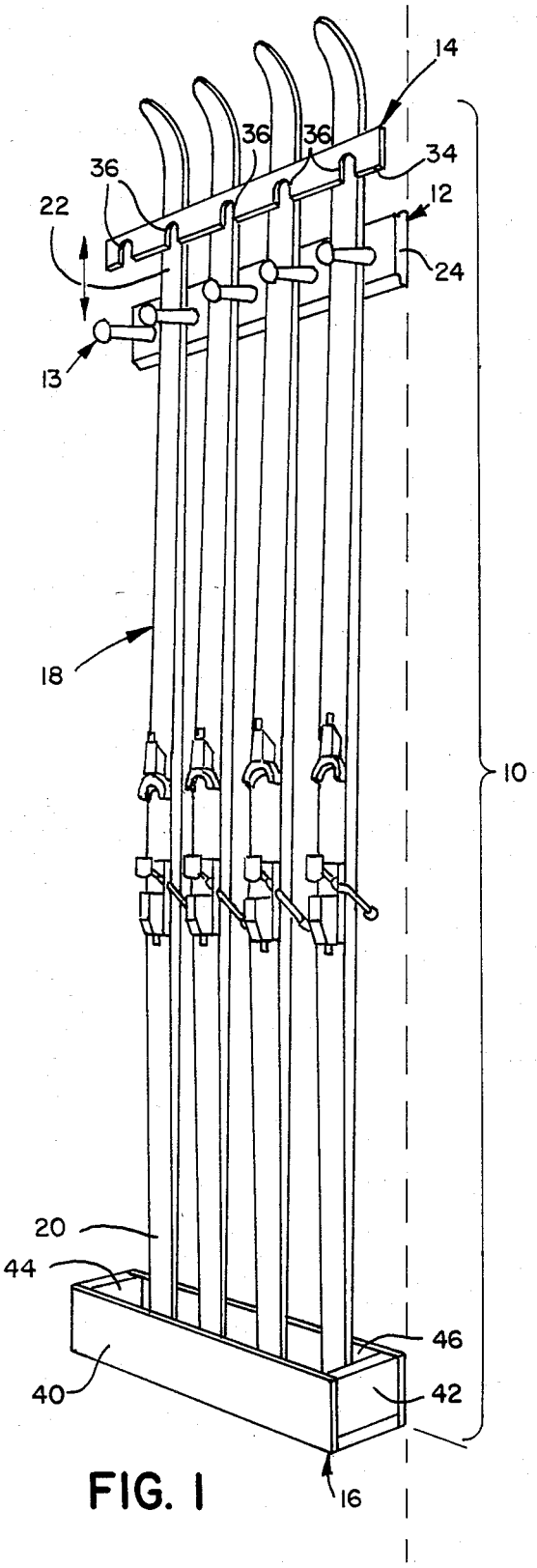
FIG. 1 is a perspective view illustrating the ski rack of the present invention and skis mounted therein and showing the keeper board removed from the peg board.

A ski rack constructed in accordance with a preferred embodiment of the invention is illustrated in the drawings and generally designated 10. The ski rack generally comprises peg board 12, keeper board or bar 14, and lower support box 16. Skis 18 are supported within rack 10 by removing keeper bar 14 from peg board 12, positioning lower end 20 of each ski within support box 16, and placing upper end 22 of each ski between a pair of adjacent pegs 13. After skis 18 have been so positioned, keeper bar 14 is slid downwardly onto pegs 13 (FIGS. 2 and 3) to secure the skis between the keeper board and the peg board. Skis can be subsequently removed from rack 10 by removing keeper board 14 and then removing skis 18 from peg board 12 and support box 16.

Turning specifically to the construction of the various elements of ski rack 10, peg board 12 (FIGS. 1-3) comprises generally planar rectangular base or support 24, which is secured to wall 26 or other generally vertical support surface using suitable fastening means, such as screws. A plurality of pegs 13 extend from base 24 in generally a common direction, which in the preferred embodiment is generally perpendicular to base 24. Pegs 13 are generally linearly aligned along the length of base 24; and when the base is horizontally secured to wall 26, pegs 13 are horizontally spaced a generally uniform distance sufficient to permit skis 18 to be vertically positioned between each pair of adjacent pegs individually or in pairs, ski bottom to ski bottom.

Each of pegs 13 (FIG. 3) comprises shaft 28 and tenon 29 secured within base 24, and more particularly within aperture 30. Each of pegs 13 further includes head 32 extending from shaft 28 generally opposite base 24. Preferably, each of pegs 13 is identical to the others to facilitate manufacture and is generally circular in cross section throughout its length. The width or diameter X of head 32 is wider than the maximum width or diameter Y of shaft 28.

Keeper board 14 (FIGS. 1–3) is a generally planar rectangular member approximately the same length as base 24. Keeper board 14 includes lower edge 34 and a plurality of downwardly opening slots or cutouts 36 along the lower edge. One slot 36 is provided for each peg 13, and the slots are spaced along lower edge 34 so that all of the slots simultaneously receive all of the pegs. Each of slots 36 is generally U-shaped, comprising a pair of parallel sides 36*a* and 36*b* (FIG. 3) defining a slot width Z. Slot width Z is slightly wider than shaft width Y and slightly more narrow than head width X so that the slot will receive shaft 28 but is prevented from passing axially beyond head 32 after keeper board 14 is slid onto pegs 13.

Lower support box or assembly 16 (FIGS. 1 and 2) is an upwardly opening box including bottom 38 and four walls 40, 42, 44, and 46 extending upwardly therefrom to define a right prism. Box 16 rests on the building floor 47. Preferably, box 16 is located directly below peg board 12 so that skis 18 may be positioned between the box and peg board.

In the preferred embodiment, all elements of rack 10 are fabricated of wood. Of course, virtually any other material can be used, such as plastic or metal.

Operation

Figure 2:
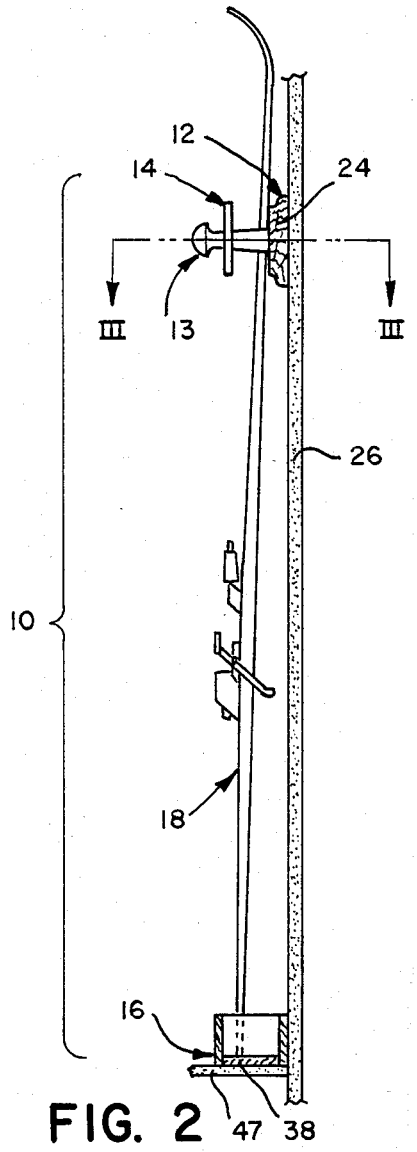
FIG. 2 is a side elevational view of the ski rack and skis illustrated in FIG. 1 showing the keeper board installed on the peg board.
Figure 3:
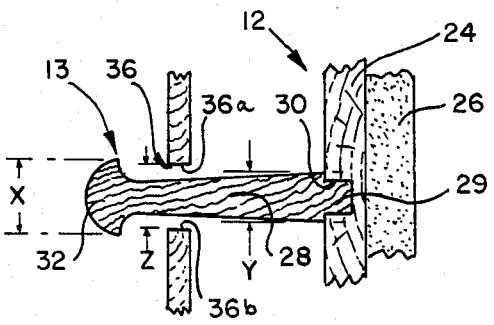
FIG. 3 is a fragmentary sectional view taken along plane III—III in FIG. 2 with the skis omitted.

Ski rack 10 is typically sold in kit form including peg board 12, keeper board 14, and box 16. Optionally, fastening means (not shown) for securing peg board 12 to wall 26 is included within the kit. Ski rack 10 is installed by securing peg board 12 to wall 26 in a generally horizontal orientation as illustrated in FIGS. 1 and 2 at a height above the floor to receive the upper ends 22 of skis 18. Box 16 rests on floor 47 directly below peg board 12 so as to open upwardly toward the peg board. Although keeper board 14 may be kept in any convenient location when skis are not mounted in rack 10, the keeper board is typically left mounted on pegs 13.

Skis are mounted in rack 10 by first removing keeper board 14 from peg board 12. Skis 18 to be stored are then positioned within rack 10 by placing lower end 20 of each ski within box 16. The protection afforded the lower ends 20 by box 16 reduces the possibility that the skis will inadvertently slide away from the wall at floor 47. Upper ends 22 of skis 18 are then positioned between pegs 13. One method is illustrated in FIG. 1. Variations of this method of placement of the skis in the rack include placement of the bottoms of skis 18 against the shaft of peg 13 and the edge of the ski adjacent the base or placement of skis 18 bottom-to-bottom so that the top of one ski rests on a peg. Keeper bar 14 is then mounted or supported on pegs 13 with each of slots 36 receiving one of peg shafts 28.

Because slot width Z is wider than shaft width Y, the slots easily slide over the pegs during installation. Further, because slot width Z is more narrow than head width X, the keeper bar 14 cannot pass axially beyond heads 32 after being mounted on pegs 13. Therefore, skis 18 are positively retained against wall 26 and occupy a minimum of space within the building interior. Skis 18 are easily removed from rack 10 by first removing keeper board 14 from pegs 13 and then removing the skis from peg board 12 and box 16.

The ski rack can also be used to hold tennis racquets, racquetball racquets, fishing rods, etc.; hence, it is very versatile as a holding device.

The above description is that of a preferred embodiment of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A ski-storage device comprising:

a peg board to be secured to a vertical support surface, said peg board including a base and a plurality of generally linearly aligned peg members extending in generally a common direction away from said base, at least two of said peg members each including a shaft portion and an enlarged head portion extending from said shaft portion generally opposite said base, said peg members being horizontally spaced to receive vertically oriented skis therebetween; and a keeper bar removably supported on said pegs, said keeper bar being completely unattached with respect to said peg board so as to be entirely removable from said peg board to permit ready access to said peg board, said keeper bar defining a plurality of downwardly facing openings to receive said shaft portions when said keeper bar is supported thereon, said openings having a width wider than said shaft portion and more narrow than said head portion, whereby when said keeper bar is supported on said pegs to secure skis between said keeper bar and said base, said keeper bar cannot pass axially beyond said peg heads.

2. A ski-storage device as defined in claim 1 further comprising a lower support assembly to rest on the floor below said peg board to support the lower ends of skis stored in said rack, said assembly being free of said peg board to be movable independently thereof.

3. A ski-storage device as defined in claim 2 wherein said lower support assembly comprises an upwardly opening box.

4. A ski-storage device as defined in claim 3 wherein all of said peg members are generally identical to one another.

5. A ski-storage device as defined in claim 2 wherein all of said peg members are generally identical to one another.

6. A ski-storage device as defined in claim 1 wherein all of said peg members are generally identical to one another.

7. A ski rack kit comprising:

a peg board including a base to be mounted on a vertical support surface and a plurality of linearly aligned pegs extending generally in a common direction therefrom, each pair of adjacent pegs being spaced to receive a ski therebetween, each of said pegs including a shaft extending from said base and an enlarged head extending from said shaft opposite said base; and a keeper removably mountable on said peg shafts, said keeper being completely unattached with respect to said peg board so as to be entirely removable from said peg board to permit ready access to said peg board, said keeper defining a plurality of downwardly opening slots to receive said peg shafts when said keeper is mounted thereon, each of said slots being sufficiently wide to receive said associated peg shaft and sufficiently narrow to prevent said keeper from passing axially past said peg heads after being mounted on said pegs to secure skis between said keeper and said peg board base.

8. A ski rack kit as defined in claim 7 further comprising a lower support assembly to rest on the floor below said peg board to support the lower ends of skis stored in said ski rack, said assembly being free of said peg board to be movable independently thereof.

9. A ski rack kit as defined in claim 8 wherein said lower support assembly comprises an upwardly opening box.

10. A ski rack kit as defined in claim 9 wherein said pegs are generally identical to one another.

11. A ski rack kit as defined in claim 18 wherein said pegs are generally identical to one another.

12. A ski rack kit as defined in claim 7 wherein said pegs are generally identical to one another.

13. A method of storing skis in a generally vertical orientation comprising:

positioning an upper portion of each ski in a peg board between a pair of pegs extending from a common support, each peg including a shaft portion having a shaft width and a head portion having a head width larger than the shaft width, the head extending from the shaft portion generally opposite the support; and mounting a separate keeper on and between said pegs between the head portions and the skis, said keeper defining a plurality of downwardly opening cutouts to receive the shaft portions, the width of said cutouts being larger than the shaft width and smaller than the head width, whereby the skis are entrapped between the keeper and support.

14. A method of storing skis as defined in claim 13 further comprising supporting a lower end of each ski on a lower support assembly located below the peg board and movable independently thereof.

15. A method of storing skis as defined in claim 14 wherein said supporting step comprises supporting the lower end of each ski in an upwardly opening box located below the peg board.

* * * * *

UNITED STATES PATENT AND TRADEMARK OFFICE

CERTIFICATE OF CORRECTION

PATENT NO. : 4,508,229

DATED : April 2, 1985

INVENTOR(S) : William G. Yost, Jr.

It is certified that error appears in the above-identified patent and that said Letters Patent is hereby corrected as shown below:

Column 1, line 67:
"eaily" should be --easily--; and

Column 5, line 17:
"18" should be --8--.

Signed and Sealed this

*Thirteenth* Day of *August 1985*

[SEAL]

*Attest:*

DONALD J. QUIGG

*Attesting Officer* *Acting Commissioner of Patents and Trademarks*